United States Patent [19]

Matthews

[11] Patent Number: 4,460,229

[45] Date of Patent: Jul. 17, 1984

[54] FLAT CABLE CONNECTOR HAVING COVER-CABLE RETENTION

[75] Inventor: Russell H. Matthews, Chino, Calif.

[73] Assignee: Thomas & Betts Corporation, Raritan, N.J.

[21] Appl. No.: 502,822

[22] Filed: Jun. 9, 1983

Related U.S. Application Data

[63] Continuation of Ser. No. 250,049, Apr. 1, 1981, abandoned.

[51] Int. Cl.[3] ..... H01R 11/20

[52] U.S. Cl. ..... 339/99 R

[58] Field of Search ..... 339/99 R, 98, 97 R, 339/97 D, 107

[56] References Cited

U.S. PATENT DOCUMENTS

| | | | |
|---|---|---|---|
| 4,009,921 | 3/1977 | Narozny | 339/99 R |
| 4,062,615 | 12/1977 | Navarro | 339/98 |
| 4,068,912 | 1/1978 | Hudson, Jr. et al. | 339/99 R |
| 4,192,570 | 3/1980 | Van Horn | 339/98 |
| 4,243,288 | 1/1981 | Lucius et al. | 339/99 R |
| 4,311,356 | 1/1982 | Levitt | 339/99 R |
| 4,344,665 | 8/1982 | Racilla et al. | 339/99 R |

*Primary Examiner*—Joseph H. McGlynn
*Assistant Examiner*—Paula Austin
*Attorney, Agent, or Firm*—Robert M. Rodrick; Salvatore J. Abbruzzese

[57] ABSTRACT

An electrical connector for terminating flat multiconductor cable has a base supporting a plurality of insulation-piercing contacts in preselected pattern and includes a cover having ledges disposed in non-interfering relation to the contact pattern and adapted to retain marginal portions of the cable. The connector base has recesses configured complementally to the ledges for receiving the ledges in the course of cable terminating.

10 Claims, 2 Drawing Figures

FLAT CABLE CONNECTOR HAVING COVER-CABLE RETENTION

This is a continuation of application Ser. No. 250,049, filed Apr. 1, 1981 abandoned.

FIELD OF THE INVENTION

This invention relates to electrical connectors and pertains particularly to connectors for the insulation-piercing termination of flat multiconductor cable.

BACKGROUND OF THE INVENTION

One basis for categorizing the myriad of insulation-piercing or insulation-displacing (IDC) connectors presently known is housing structure. Connector housings are of several types, a first in most common use wherein the housing has separately made mutually-movable parts, including a base and a latchable cover. The base fixedly supports contacts in common attitude for cable piercing and the cover is latched in first (open) position on the base to define with the base a channel through which a cable may be introduced to have its individual conductors placed in registry with the contacts. Through the use of a bench press or like tooling, the base and cover are displaced toward one another to force the contacts through cable insulation into gas-tight connection with the conductors, whereupon the cover is latched in second (closed) position upon the base. In a second connector type, a separable cover is provided with a full slot for receipt and retention of a cable therein. Contacts pass through openings in the portion of the cover below the cable, through the cable and into engagement with the cable conductors upon being crimped toward a base. In a third connector type, the housing comprises a unitary structure including an integral base and cover and provides a channel for cable receipt and support from which contacts are spaced during cable introduction. After the cable is seated in the channel, contacts are forced into and across the channel, piercing the cable insulation and providing the requisite gas-tight connection.

The matter of providing necessary registry of individual conductors and corresponding contacts prior to the piercing stage is more easily addressed in the second and third connector types as the cable is fully bounded by support structure which provides position control as between the individual conductors and housing slots through which the contact travel is fixed. In the second type connector, as shown, for example, in U.S. Pat. No. 4,068,912, the cover comprises hinged sections respectively bounding opposite sides of the cable and latched to one another at ends distal from the hinge portion. The hinged section bounding the underside of the cable defines contact-guide passages akin to those found in the unitary housing of the third connector type above discussed. To this extent, the '912 approach is seen as a hybrid type, combining features of the separable cover-base connector with features of the unitary housing connector resulting in a separable cover-base connector having a relatively high structural profile.

In the first connector type, as above described in basic form, the cable is unsupported by the cover and derives full positional support from the contacts, upon which the cable rests prior to and during termination. Various efforts have been advanced to provide assistance in the first connector type for cable positional control, inclusive of elements additive to the cover and base in the form of adapters and the like applied to the cable during preparation of the cable for termination.

SUMMARY OF THE INVENTION

The present invention has as its primary object the provision of a separable cover-base insulation-piercing connector having simplified cover support for cable positioning.

In attaining the foregoing and other objects, the invention provides a connector having a base fixedly supporting insulation-piercing contacts in longitudinal succession and a cover latchable to the base in first position for defining therewith a cable-receiving channel, the cover including customary continuous longitudinal surface for engaging the cable and forcing same into insulation-pierced engagement with the contacts in the course of movement into second latched position with respect to the base, the cover further defining cable support means extending partially longitudinally with the customary surface thereof and in spaced relation transversely thereof. The cover cable support means provides free access of contacts to conductors of the cable and, in its preferred embodiment, comprises a pair of longitudinally opposed ledges disposed below the customary cover surface for engaging the cable. The base is preferably configured with recesses complemental to the cover ledges. As is shown below, the cable support ledges may be provided without requiring any lengthwise expansion of the connector beyond its length in the absence of the cable support means.

The foregoing and other features of the invention will be further evident from the following detailed discussion of a preferred embodiment thereof and from the drawings, wherein like reference numerals are used to identify like parts throughout.

DETAILED DESCRIPTION OF THE PREFERRED EMBODIMENT

Figure 1:
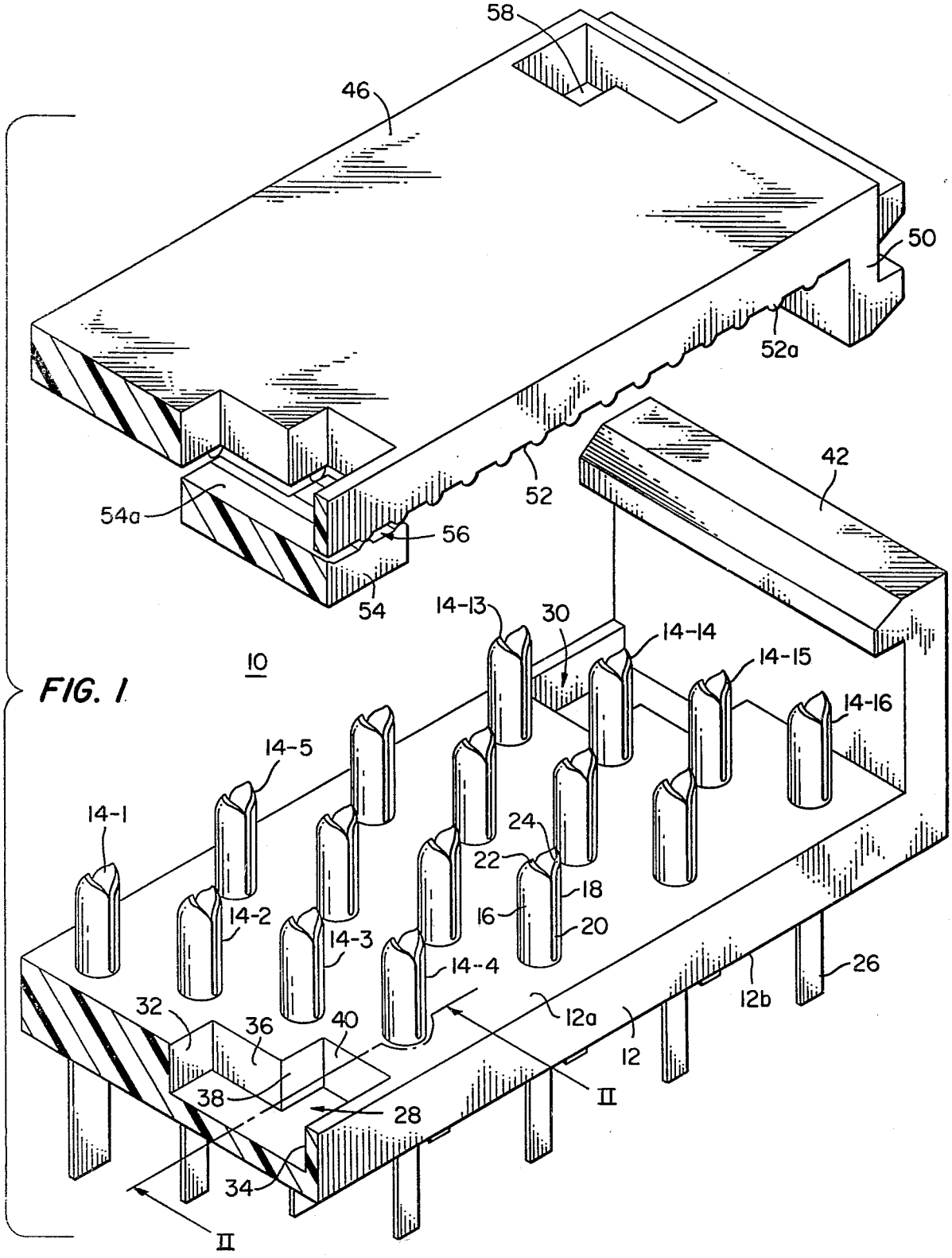
FIG. 1 is an exploded perspective view of a connector in accordance with the invention, the leftward portion of the connector housing being omitted for clarity.

Referring to FIG. 1, connector 10 includes base 12, an elongate body comprised of electrically insulative material, typically a plastic substance. The base fixedly supports contacts 14 in common attitude extending transversely outwardly of base upper surface 12*a*. The contacts are of insulation-piercing type, such as is shown in detail in U.S. Pat. No. 3,964,816 issued June 22, 1976 to Narozny, commonly assigned herewith, and including upstanding arms 16 and 18 defining slot 20 therebetween. Arms 16 and 18 have sharpened upper ends 22 and 24, adapted to engage and pierce cable insulation.

Contacts 14 are arranged longitudinally in succession in base 12 in laterally spaced rows. As illustrated, a first contact row has contact 14-1 as its leftward lead contact, a second row has contact 14-2 as its leftward lead contact, a third row has contact 14-3 as its leftward lead contact and a fourth row has contact 14-4 as its leftward lead contact. Such lead contacts are in respective longitudinally staggered positional relationship. Thus, contacts 14-1 through 14-4 are in longitudinally rightward progress and the second contact in the first row, namely, contact 14-5, is rightward of fourth row contact 14-4. In the depicted embodiment of the invention, connector 10 is adapted for seating in a printed circuit board (PCB), the board having apertures for receiving and making electrical connection with contact stems 26 which depend downwardly from base undersurface 12*b*.

Leftwardly of the lead contacts 14-3 and 14-4 of the third and fourth contact rows, base 12 includes a recess 28 and further defines recess 30 rightwardly of contacts 14-13 and 14-14 of the first and second contact rows. The recesses are of like stepped configuration. Considering recess 28, it has an expanded width portion bounded by walls 32 and 34 and in part by end wall 36. A lesser width recess portion is bounded by walls 34 and 38 and end wall 40. Latching arms 42 and 44 (FIG. 2) extend upwardly from opposite ends of the base.

Figure 2:
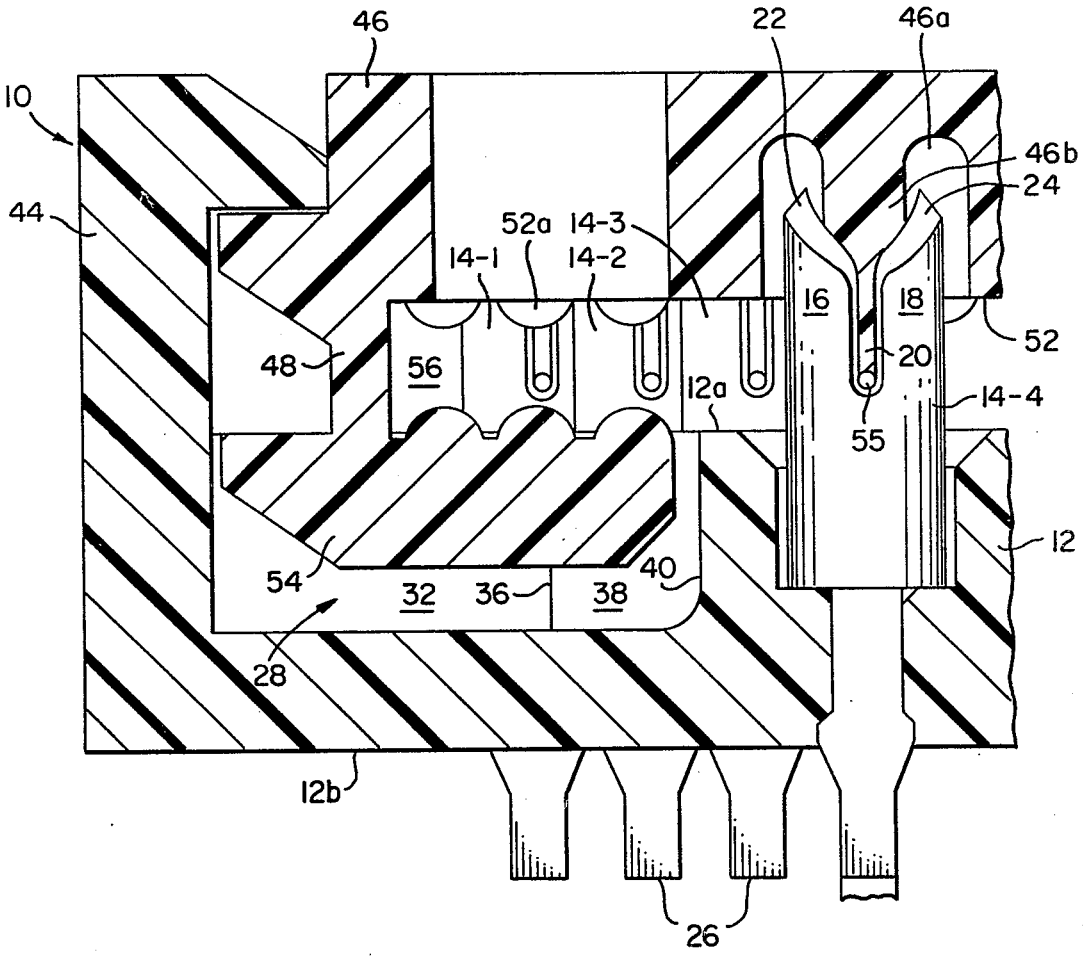
FIG. 2 is a sectional elevation of the FIG. 1 connector in assembly with a flat multiconductor cable, as seen from plane II—II of FIG. 1.

Referring to both FIGS. 1 and 2, cover 46 comprises a body elongate with base 12 and includes latch arms 48 and 50 for engagement with base arms 42 and 44 to provide the dual latch positioning arrangement discussed above. The cover has a continuous undersurface 52, ribbed as at 52*a*, and is thus adapted to engage a flat multiconductive cable and, upon being pressed upon base 12 through suitable crimping apparatus (not shown), to provide for insulation-displacement connection of contacts 14 with cable conductors 55. Latch arm 48 supports ledge 54 in parallel with surface 52, spaced vertically (transversely) therefrom to define passage 56. Diagonally opposite ledge 54, latch arm 50 supports ledge 58 in like manner relative to surface 52 such that a further passage corresponding to passage 56 is provided. The diagonally opposed ledges 54 and 58 are adapted to engage the marginal edges of the flat multiconductive cable and hold such cable in the passages between the cover 46 and the ledges 54 and 58.

The configuration of ledges 54 and 58 is complemental to the configuration of base recesses 28 and 30, whereby the ledges may freely enter into seated relation with the base in the course of crimping the cover onto the base. Such seating of the ledges 54 and 58 in the corresponding recesses 28 and 30 aligns a cable retained by the ledges relative to the base 12 and provides the desired registry between the cable conductors 55 and the contacts 14. As is shown in FIG. 2, the assembled connector finds the upper surface of ledge 54 substantially in the plane of base upper surface 12*a*. Also, as will be seen jointly from the drawings, such upper ledge surface extends partially longitudinally and partially laterally with the cover, i.e, to be outside and non-interfering with the multi-row contact array. At the same time, however, the upper ledge surface is in registry with the flat cable, underlying cable conductors pierced by contacts 14-1 and 14-2 in the case of ledge 54 and underlying cable conductors pierced by contacts 14-15 and 14-16 in the cases of ledge 58. Accordingly, the ledges provide the cover with a cable support and retention capability, yet providing an opening extending therebetween permitting collective access for the contacts to the cable in the course of crimping such that a relatively low profile connector is achieved.

In assembling the connector, the cable is first inserted into the cover with its opposed margins situated in the passages defined jointly by the cover and ledges 54 and 58. The cover may be in the open latched position above discussed at this stage. In such open or pre-crimp condition, the ledges 54 and 58 preferably extend partially into the recesses 28 and 30 providing thereby positive positioning of the cover relative to the base and registry of the cable conductors with the corresponding contacts. The cover is now crimped into contact slots 20. Contact arms 16 and 18 seat within annular recesses 46*a* formed in cover surface 52.

Various changes to the described and depicted connector will be evident to those skilled in the art. Thus, ledge and recess configurations although mutually complemental to provide interfitting thereof may take shapes other than those illustrated and yet retain the capability of cable support and retention and have non-interfering disposition with respect to the contact array, which may itself take a pattern other than that shown herein. Accordingly, it need be appreciated that the particularly disclosed embodiment is intended in an illustrative and not in a limiting sense. The true spirit and scope of the invention is set forth in the following claims.

What is claimed is:

1. An electrical connector for terminating flat multiconductor cable, said connector comprising an elongate base, a plurality of insulation-piercing contacts fixedly supported by said base in predetermined pattern and extending outwardly thereof, and a cover supported by said base and defining a first surface extending longitudinally with said base to therewith effect movement of said cable into insulation-pierced electrical connection with said contacts, said cover further defining a second surface extending partially longitudinally with said cover first surface and spaced therefrom to provide therewith a passage for receipt and support of said cable in position adjacent said cover first surface, said cover second surface being in non-interfering disposition with respect to said contact pattern.

2. The connector claimed in claim 1 wherein said cover comprises an elongate body defining said first surface and a ledge supported by said elongate body and defining said second surface.

3. The connector claimed in claim 2 wherein said base includes a recess in facing relation to said cover, said recess being disposed outwardly of said contact pattern and being configured to receive said ledge upon such electrical connection of said cable and said contacts.

4. The connector claimed in claim 3 wherein said base recess is of configuration complemental to the configuration of said ledge.

5. The connector claimed in claim 1 wherein said cover comprises an elongate body defining said first surface and having opposed ends, said cover having first and second ledges supported by said elongate body respectively adjacent said opposed ends, said cover second surface being in first and second parts respectively defined by said first and second ledges.

6. The connector claimed in claim 5 wherein said base includes first and second recesses in facing relation to said cover, each such recess being disposed outwardly of said contact pattern and being configured to receive one of said first and second ledges upon such electrical connection of said cable and said contacts.

7. The connector claimed in claim 6 wherein said base first recess is of configuration complemental to the configuration of said first ledge and wherein said second base recess is of configuration complemental to the configuration of said second ledge.

8. The connector claimed in claim 7 wherein said contact pattern provides plural longitudinally staggered laterally spaced rows of said contacts, said first and second recesses being respectively longitudinally aligned with different such contact rows.

9. The connector claimed in claim 8 wherein said contact pattern provides four such contact rows, said first recess being longitudinally aligned with the first and second of such contact rows, said second recess being longitudinally aligned with the third and fourth of such contact rows.

10. The connector claimed in claim 9 wherein said first and second recesses are of longitudinally and laterally stepped configuration.

* * * * *